United States Patent [19]

Lohrey

[11] 4,400,646

[45] Aug. 23, 1983

[54] SHAPED INLEAD WIRES IN ELECTRIC LAMPS

[75] Inventor: Edwin J. Lohrey, Euclid, Ohio

[73] Assignee: General Electric Company, Schenectady, N.Y.

[21] Appl. No.: 241,921

[22] Filed: Mar. 9, 1981

[51] Int. Cl.[3] ..... H01J 5/50

[52] U.S. Cl. ..... 313/333; 313/331

[58] Field of Search ..... 313/331, 333

[56] References Cited

U.S. PATENT DOCUMENTS 244,481 0/1881 Perkins ..... 313/333

1,379,036 5/1921 Moorehead ..... 313/331

3,673,453 6/1972 Prijn ..... 313/331

3,992,642 11/1976 McVey et al. ..... 313/331

*Primary Examiner*—Harold A. Dixon

*Attorney, Agent, or Firm*—John P. McMahon; Philip L. Schlamp; Fred Jacob

[57] ABSTRACT

Electric lamp inlead wires are provided with bends to shape them into desired configurations for holding a filament or arc tube. The bends are shaped to provide a small reverse bend section. This prevents an inherent springback tendency at the bends, and improves the permanency of the bent shapes.

5 Claims, 3 Drawing Figures

SHAPED INLEAD WIRES IN ELECTRIC LAMPS

BACKGROUND OF THE INVENTION

The invention is in the field of electric lamps having inlead wires provided with bends to shape them into desired configurations for holding a light source such as a filament or arc tube.

U.S. Pat. No. 4,208,603 to Graves and Pikus discloses various types of electric lamps containing inlead wires provided with bends to shape them into desired configurations for holding a light source such as a filament or arc tube. These inlead wires are made from a dispersion-strengthened copper alloy material resulting in wires sufficiently stiff so that they can support the light source without the need for additional support wires. Inlead wires that have been bent to a desired shape, and especially inlead wires made from a stiff and springy material such as the just-mentioned dispersion-strengthed copper alloy, retain a "memory" of their original straight shape and tend to "unbend" or "spring back", in varying degrees, toward the original straight shape. This effect can occur immediately after bending and/or over a period of time. The amount of the spring back is found to be inconsistent among bent inlead wires that have been made identically, this inconsistency being relatively greater for wires of stiffer material.

The aforesaid spring back of bent inlead wires is undesirable because it can cause a lamp's filament to sag or to stretch, and can cause a filament or arc tube to move from its original intended position in a light bulb.

SUMMARY OF THE INVENTION

Objects of the invention are to provide improved inleads for lamps, and to provide bent or shaped inlead wires having improved dimensional stability.

The invention comprises, briefly and in a preferred embodiment, an electric lamp containing inlead wires shaped or bent into desired configurations for holding a light source, such as a filament or arc tube, which is attached to the inlead wires. Certain ones or all of the bends in the inlead wires are shaped to provide a small reverse bend section which improves the permanency of the bent shapes. A preferred method of the invention comprises the steps of forming the main bend of the inlead wire by means of sliding dies which force the wire to bend against an anvil, and forming the reverse bend by moving a forming die against the outer curvature of the main bend and forming the reverse bend against a cavity in the anvil.

DETAILED DESCRIPTION OF THE INVENTION

Figure 1:
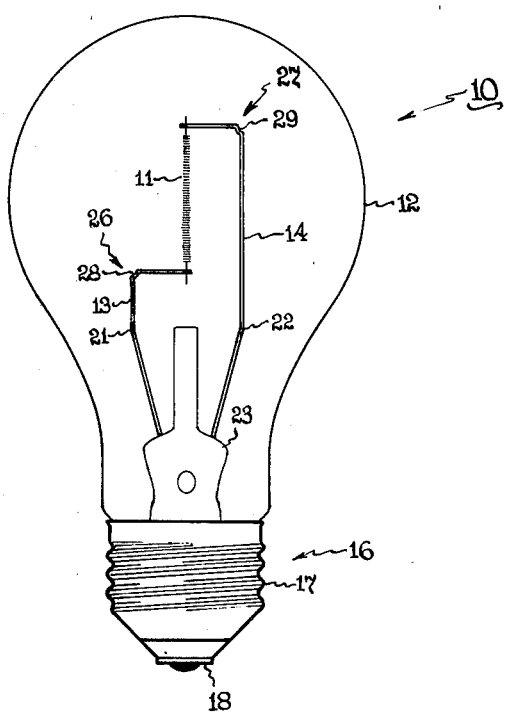
FIG. 1 is a side view of a light bulb containing a filament held by inlead wires shaped in accordance with a preferred embodiment of the invention.

In FIG. 1, a light bulb 10 contains a filament 11 disposed vertically within a bulb 12 and supported at the ends thereof by a pair of inlead wires 13, 14. The light bulb 10 is provided with a conventional screw base 16 having a threaded shell 17 which is connected to one of the inlead wires 13, and a central button contact 18 which is electrically connected to the other inlead wire 14 (these connections not being shown in the drawing). In order for the inlead wires 13, 14 to hold the filament 11 at a desired position centered within bulb 12, the inlead wires are provided with slight bends 21, 22 above the point where they emerge from a glass seal member 23, and the inleads 13, 14 are further provided with right-angle bends 26, 27, near the filament 11, so that the end regions of the inlead wires will be horizontal and can readily be clamped or otherwise attached to the ends of the filament 11, in conventional manner. Other types of light sources, such as an arc tube, can be substituted for the filament 11. The light bulb 10 thus far described is generally similar to that shown in FIGS. 1 and 2 of the aforesaid referenced patent 4,208,603; this patent also discloses an arc tube in FIG. 6 which could be substituted for the filament 11 in the present drawing. The inlead wires 13, 14 preferably are made from dispersion strengthened copper alloy such as is disclosed in the above referenced U.S. Pat. No. 4,208,603, for example as generally stated in Column 4, lines 10–14, as being formed from dispersion-strengthened copper alloy having a surface metallurgical structure of the fibrous alloy crystals which is essentially devoid of copper matrix metal and which has been nickel-plated in conventional fashion. The material is sufficiently strong and stiff that the inleads can support the light source 11 without the need for additional support wires. As has been described above, however, such stiff inlead wire material tends to have an undesirable spring-back tendency by which bends, such as 26 and 27, tend to unbend slightly, thus tending to dislocate the light source 11 from its intended position, or also, if the light source is a filament, this undesirable spring-back or movement of the inleads where bent, can stretch the filament 11 or cause it to sag, depending on the relative amounts of spring-back of the two inlead wires.

In accordance with the invention, each of the inlead wire bends 26 and 27 are respectively provided with small reverse bends 28 and 29. The reverse bends 28 and 29 are respectively located at the junction or corner region formed by the diverging segments of the inlead wire bends 26 and 27. The reverse bends 28 and 29 are respectively in the opposite or reverse direction to the corner region of inlead wire bends 26 and 27. The reverse bends 28 and 29 are so dimensioned, such as by depth and length, to provide a reverse spring-back characteristic at each inlead wire bend 26 or 27 which is approximately equal to and offsets the aforesaid spring-back tendency of the inlead wire bends 26 and 27. The inlead wire bends 26 and 27 each form the main bend of the inlead wires 13 and 14, respectively, of the present invention. The reverse bends 28 and 29 each form a reverse bend of the inlead wires 13 and 14, respectively, of the present invention. The main bend 26 along with the reverse bend 28 located at the outer part of the main bend at its junction or corner region both form a composite bend of the present invention of inlead wire 13; whereas, the main bend 27 along with the reverse bend 29 located at the outer part of the junction or corner region both form a composite bend of the present invention of the inlead wire 14. The inlead wires 13 and 14 each having a composite bend of the present invention are dimensionally stable and hold the light source 11 in its intended position during the life of the light bulb. Although reverse bends are shown at the right angle bends 26, 27 (the sharper the bend, the greater is the tendenacy of the undesired spring-back effect), reverse bends can also be applied to the slight bends 21, and 22 in the inlead wires 13, 14 if these slight bends should have a spring-back problem.

Figure 2:
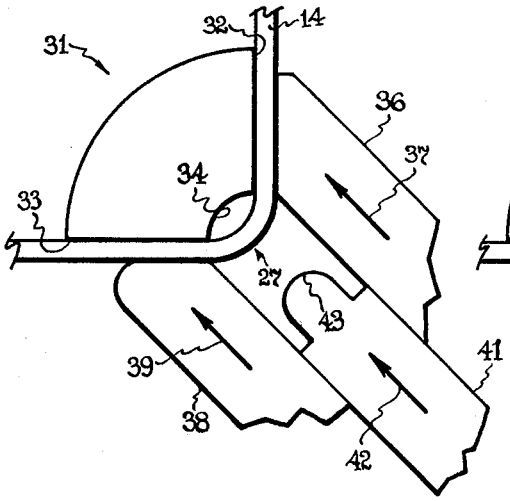
FIG. 2 illustrates a step in shaping the inlead wires by means of tools or dies.
Figure 3:
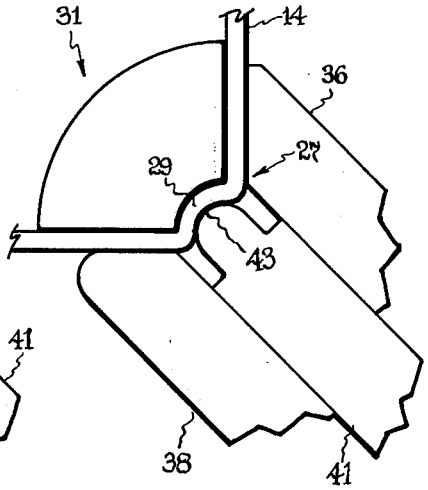
FIG. 3 illustrates the final step of shaping inlead wires in accordance wih a preferred embodiment of the invention.

FIGS. 2 and 3 illustrate a preferred method of forming the composite bend in inlead wires. The composite bending of inlead wire 14 is shown for the purpose of illustration. An anvil member 31 is provided with first and second sides 32, 33 having an angle with respect to each other equal to the desired angle of the bend to made in the inlead wire, for example 90° in the embodiment shown. The anvil 31 is provided with a cavity 34 at the junction region of the aforesaid sides 32 and 33. To form the first bend 27, from a piece of straight inlead wire, the inlead wire 14 is clamped against the anvil side 32 by a first sliding die 36 which moves in the direction 37 so as to clamp the wire 14 against the anvil side 32, whereupon a second slighting die 38 moves in the direction 39 so as to bend the wire 14 at a right angle and against the anvil side 33, as shown, thereby forming the first or main bend 27 in the wire 14. A forming die 41 then moves in the direction of arrow 42, and is provided with a curved tip 43 which engages against the outer curvature of the first bend 27 and deforms a portion of the wire at the bend 27 against the curved rear surface of the cavity 34, so as to form the reverse bend 29. This results in a compound bend which, as explained above, has much greater dimensional stability than would the bend 27 alone have. The dies 36, 38, and 41 are then retracted and the formed inlead wire 14 is removed from the bend forming apparatus.

While preferred embodiments and modification have been shown and described, various other embodiments and modifications will become apparent to persons skilled in the art and will fall within the scope of the invention as defined in the following claims.

What I claim as new and desire to secure by United States Letters Patent is:

1. An electrical lamp comprising a light source and inlead wires supporting said light source, at least one of said inleads being provided with a compound bend, said compound bend being comprised of a main and a reverse bend both of which are interrelated, said main bend being placed at a location along said inlead wire and defining two divergent segments of said inlead which are interconnected by a corner section having a desired angle, said reverse bend being located at said corner section and extending into the region between said divergent segments.

2. A lamp as claimed in claim 1, wherein said main bend and said reverse bend are shaped and dimensioned to stabilize the shape of said compound bend.

3. A lamp as claimed in claim 1, wherein said inlead wires are made from dispersion-strengthened copper alloy material.

4. A method of bending at least one inlead wire for a light source so as to form a composite bend comprising the steps of:

(a) providing fixture means having a first and a second side separated from each other by an angle corresponding to a desired angle of a portion of said inlead between a first and a second portion of said inlead, said first and second sides of said fixture being interconnected by an inwardly curved surface;

(b) positioning said inlead into said fixture and locating the inlead so that the desired angle between the first and second portions is located near the inwardly curved surface of said fixture means, said desired angle of such inlead corresponding to a main bend in said inlead;

(c) applying a force to said inlead so that the portion of the inlead having the main bend is deformed against and takes the shape of said inwardly curved surface so as to form a reverse bend in said inlead, said reverse bend and said main bend both forming said composite bend of said inlead.

5. A method of bending wire comprising the steps of (1) forming a main bend by pressing a wire against sides of an anvil, and (2) forming a reverse bend by holding the wire against said sides of the anvil and pressing the wire at the outer part of the main bend.

* * * * *